US005954366A

United States Patent [19]

Forman

[11] Patent Number: 5,954,366

[45] Date of Patent: Sep. 21, 1999

[54] PLATFORM ATTACHMENT FOR AN IN-LINE SKATE

[76] Inventor: Kathy Forman, 3008 Bedminster Rd., Perkasie, Pa. 18944

[21] Appl. No.: 08/971,941

[22] Filed: Nov. 17, 1997

[51] Int. Cl.[6] ..... A63C 17/06

[52] U.S. Cl. ..... 280/811; 280/11.22

[58] Field of Search ..... 280/11.19, 11.22, 280/809, 811, 825, 14.2, 87.041, 87.042

[56] References Cited

U.S. PATENT DOCUMENTS

| | | | |
|---|---|---|---|
| 4,022,482 | 5/1977 | Powell | 280/809 |
| 5,398,948 | 3/1995 | Mathis | 280/11.19 |
| 5,586,777 | 12/1996 | Wolf | 280/11.22 |
| 5,642,894 | 7/1997 | Sanabria | 280/11.27 |
| 5,791,664 | 8/1998 | Koester, Jr. | 280/11.2 |
| 5,848,796 | 12/1998 | Meibock et al. | 280/11.22 |

*Primary Examiner*—J. J. Swann
*Assistant Examiner*—David R. Dunn
*Attorney, Agent, or Firm*—LaMorte & Associates

[57] ABSTRACT

A skate assembly that includes a skate and a platform that extends from the skate. The purpose of the platform is to provide a place for a skater to place his/her free foot when skating on one foot. The skate has a boot, a rigid sole disposed at the bottom of the boot and a rail structure that descends from the sole. The sole has a first predetermined width. The rail structure has a second predetermined width that is more narrow than that of the sole. The platform extends rearwardly from the skate. The platform extends beyond the sole of the skate a distance sufficient to provide a surface external of the skate boot that is large enough for a skater's foot to rest. The platform can be made either as an integral part of the skate itself or as an independent unit that can be retroactively added to an existing prior art skate.

7 Claims, 5 Drawing Sheets

PLATFORM ATTACHMENT FOR AN IN-LINE SKATE

BACKGROUND OF THE INVENTION

1. Field of the Invention

The present invention relates in general to skates such as in-line skates and ice skates. More particularly, the present invention relates to devices that attach to the structure of an in-line skate in order to enhance the performance of the in-line skate.

2. Description of the Prior Art

In recent years, skating with both in-line skate and ice skates have become increasingly popular. In addition to recreational use, there now exist many professional and semi-professional sport activities where the players wear skates. For example, there are roller hockey leagues, speed skating competitions, free style skating competitions and the like.

Skates are commonly worn on both feet. However, when skating, there are many times that a skater will skate with only one foot, while the other foot is held suspended in the air. Furthermore, many skaters skate with only one skate, wherein the opposite foot is clad in an ordinary shoe. When skating with only one skate, the skater has much greater control of his/her movement and can perform complex maneuvers that are not possible if both feet were in skates.

Regardless, whether a person is skating with one skate or two skates, when a person skates on only one foot, the opposite foot must be held in the air. This is tiresome to the person skating. Furthermore, the suspended foot is commonly held out to the side of the body. This alters the center of gravity of the skater, thereby making it more difficult to maintain one's balance during some skating maneuvers.

A need therefore exists for a platform device that can attach to a single skate, wherein the platform provides a place to place the opposite foot when skating with only one foot. By supporting the opposing foot, the suspended leg can be rested and the skater is provided with a consistent center of gravity throughout various maneuvers.

This need is provided for by the present invention as set forth in the below description and claims.

SUMMARY OF THE INVENTION

The present invention is a skate assembly that includes a skate and a platform that extends from the skate. The purpose of the platform is to provide a place for a skater to place his/her free foot when skating on one foot. The skate has a boot, a rigid sole disposed at the bottom of the boot and a rail structure that descends from the sole. The sole has a first predetermined width. The rail structure has a second predetermined width that is more narrow than that of the sole. The platform extends rearwardly from the skate. The platform extends beyond the sole of the skate a distance sufficient to provide a surface external of the skate boot that is large enough for a skater's foot to rest. The platform can be made either as an integral part of the skate itself or as an independent unit that can be retroactively added to an existing prior art skate.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention platform device can be used in conjunction with an ice skate, the present invention platform device is particularly well suited for use with an in-line skate. Accordingly, by way of example, the present invention will be described in conjunction with an in-line skate.

Figure 1:
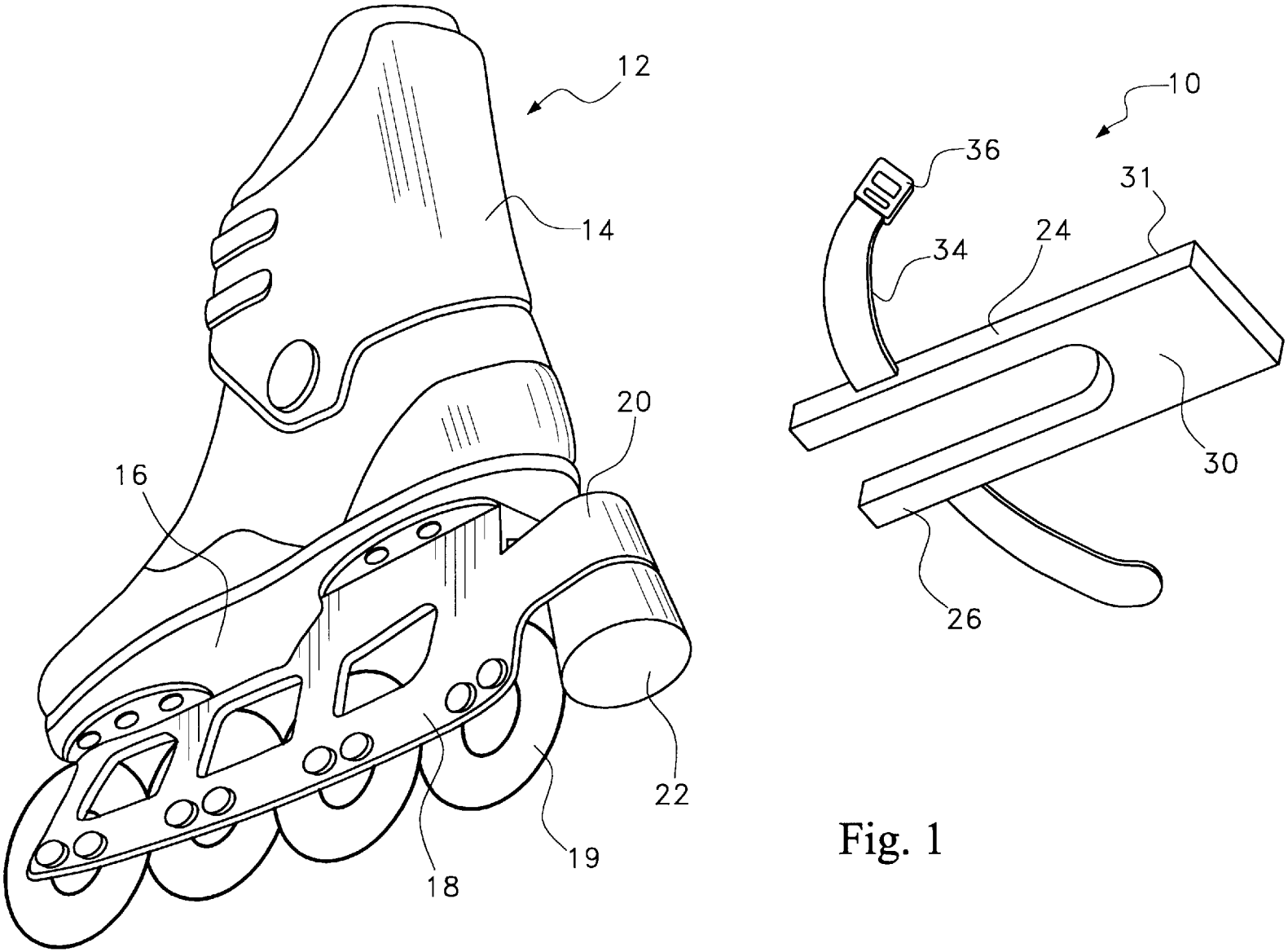
FIG. 1 is a perspective view of one preferred embodiment of the present invention platform device shown in conjunction with an in-line roller skate.

Referring to FIG. 1, an exemplary embodiment of the present invention platform device 10 is shown in conjunction with a typical in-line skate 12. In-line skates, such as that shown, commonly have a boot 14 mounted to a rigid sole 16. A rail structure 18 is mounted to the rigid sole 16, wherein the rail structure 18 supports the various skate wheels 19. In a pair of ice skates (not shown) the rail element would terminate at the bottom with the sharpened skating blade.

The rail structure 18 is typically much narrower than is the sole 16 of the skate 12. The rail structure 18 has a predetermined width at the point where the rail structure 18 is mounted to the rigid sole 16.

A break arm 20 typically extends rearwardly from the rail structure 18 of an in-line skate 12. The break arm 20 supports a rubber stopping element 22 that serves as the break for the in-line skate 12. The break arm 20 that supports the rubber stopping element 22 extends from the skate 12 beyond the rear heel of the in-line skate 12.

Figure 2:
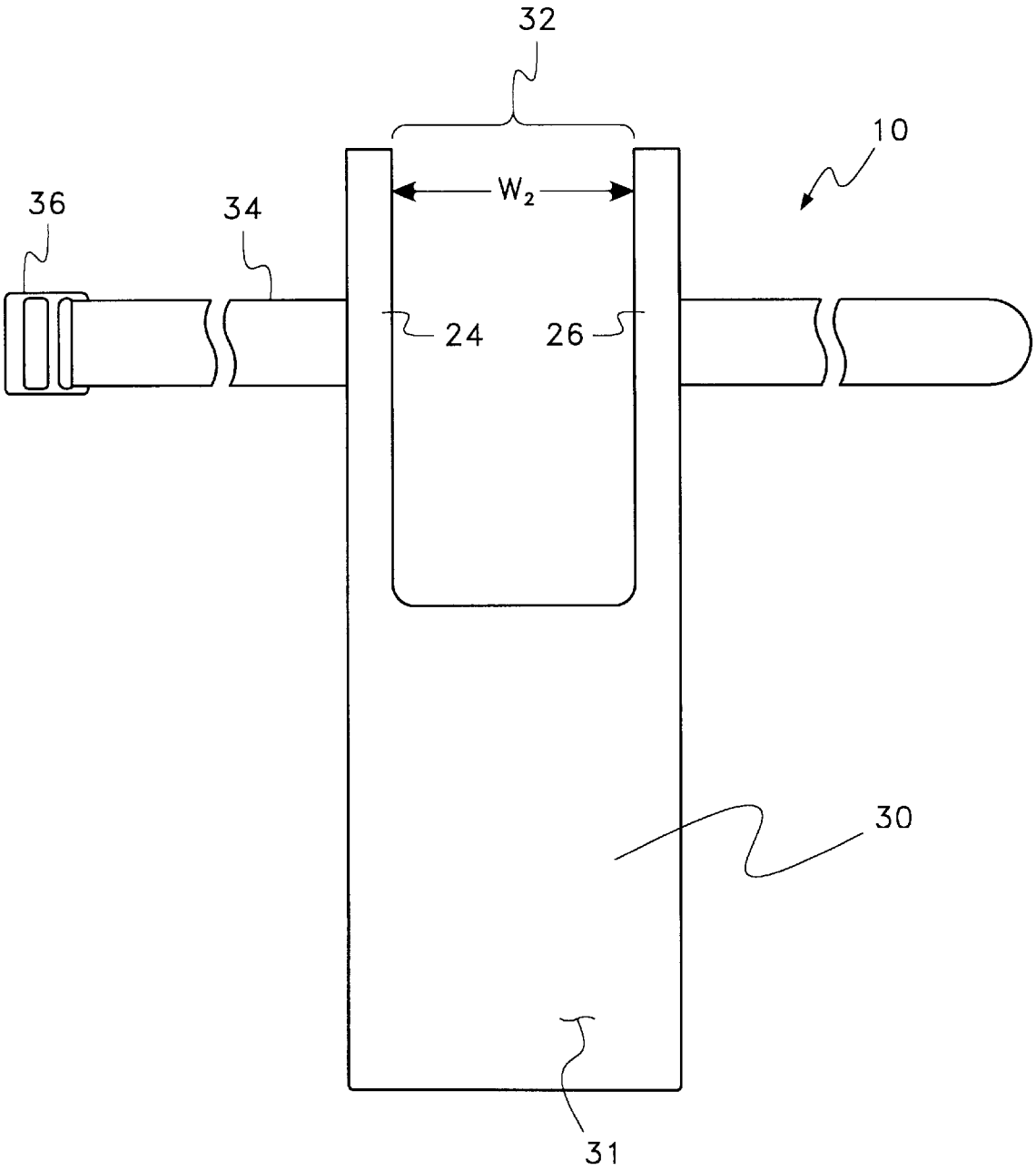
FIG. 2 is a top view of the embodiment of the platform device shown in FIG. 1.

Referring to FIG. 2 in conjunction with FIG. 1, it can be seen that the platform device 10 has two elongated arms 24, 26 that extend from a common base section 30. A gap 32 exists between the two elongated arms 24, 26. The gap 32 has a width W2 that is slightly wider than is the width of the rail structure 18 (FIG. 1) where the rail structure 18 mounts to the sole 16 of the skate 12. The common base section 30 of the platform device 10 has a flat top surface 31. It is preferred that the top surface 31 and the bottom surface of the common base section 30 be identical so that the platform device 10 can be put into place either right side up or upside down without discretion.

A flexible strap 34 extends from each of the elongated arms 24, 26 on the platform device. The straps terminate with some form of a mechanical fastener 36 that can join the ends of the straps 34 together at various lengths. The mechanical fastener 36 may be any strap connecting mechanism such as buckles, clasps, or patches of hook and loop material.

Figure 3:
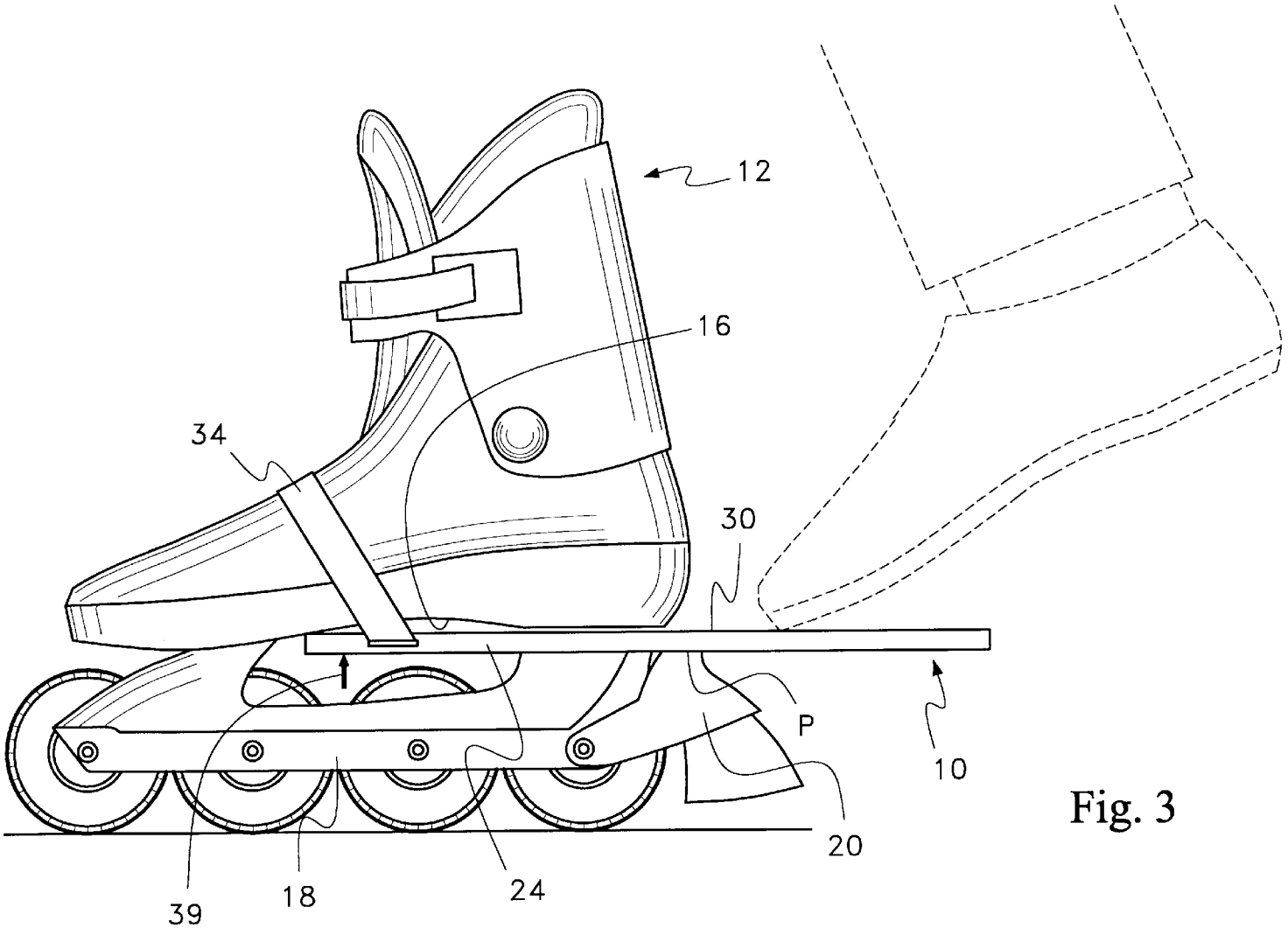
FIG. 3 is a side view of the embodiment of FIG. 1 shown while attached to an in-line skate.

Referring to FIG. 3 in conjunction with FIG. 1, it can be seen that to attach the platform device 10 to an in-line skate 12, the rail structure 18 of the in-line skate 12 is passed into the gap 32 (FIG. 2) in between the elongated arms. Since the width W2 of the gap is slightly larger than the width of the rail structure 18, the rail structure 18 passes into the gap unobstructed until the rail structure 18 abuts against the common base section 30 between the two elongated arms 24, 26. Once fully advanced onto the skate 12, the bottom of the common base section 30 of the platform device 10 abuts against the break arm 20 at an abutment point P. The abutment point P acts as a fulcrum point for the platform device 10. Referring solely to FIG. 3, it can be seen that as a person steps upon the common base section 30 of the platform device 10, the platform device 10 pivots about the abutment point P. This causes the elongated arms 24, 26 to pivot upwardly in the direction of arrow 39 until the elongated arms 24, 26 abut against the bottom of the skate's rigid sole 16. The gap 32 (FIG. 2) between the elongated arms 24, 26 is narrower than the sole 16 of the in-line skate 12. Consequently, the arms 24, 26 abut against the skate's sole 16 when biased upwardly.

When the elongated arms 24, 26 of the platform device 12 are biased against the sole 16 of the in-line skate 12, a cantilever structure is created that supports the common base section 30 of the platform device 10 in a generally horizontal plane. The straps 34 help to maintain the elongated arms 24, 26 in abutment with the rigid sole 16 of the in-line skate 20. The straps 34 pass around the top of the skate 12 and are joined in a taut condition with some type of mechanical fastener. The presence of the straps 34 prevent the platform device 10 from rocking about abutment point P. Furthermore, the presence of the straps 34 prevents the platform device 10 from falling away from the skate 10 as a skater performs different maneuvers.

From FIG. 3, it can be seen that when a person skates on one foot, the opposite foot can be placed on the common base support 30 of the platform device. Once in this position, the skater's two feet are linearly aligned. Accordingly, the skater's center of balance is maintained in line with both of his/her feet. Furthermore, a skater can use the platform device 10 to tilt the skate 12 backward and cause the skate's break to be applied. Thereby enhancing the breaking performance of the skate 12.

Figure 4:
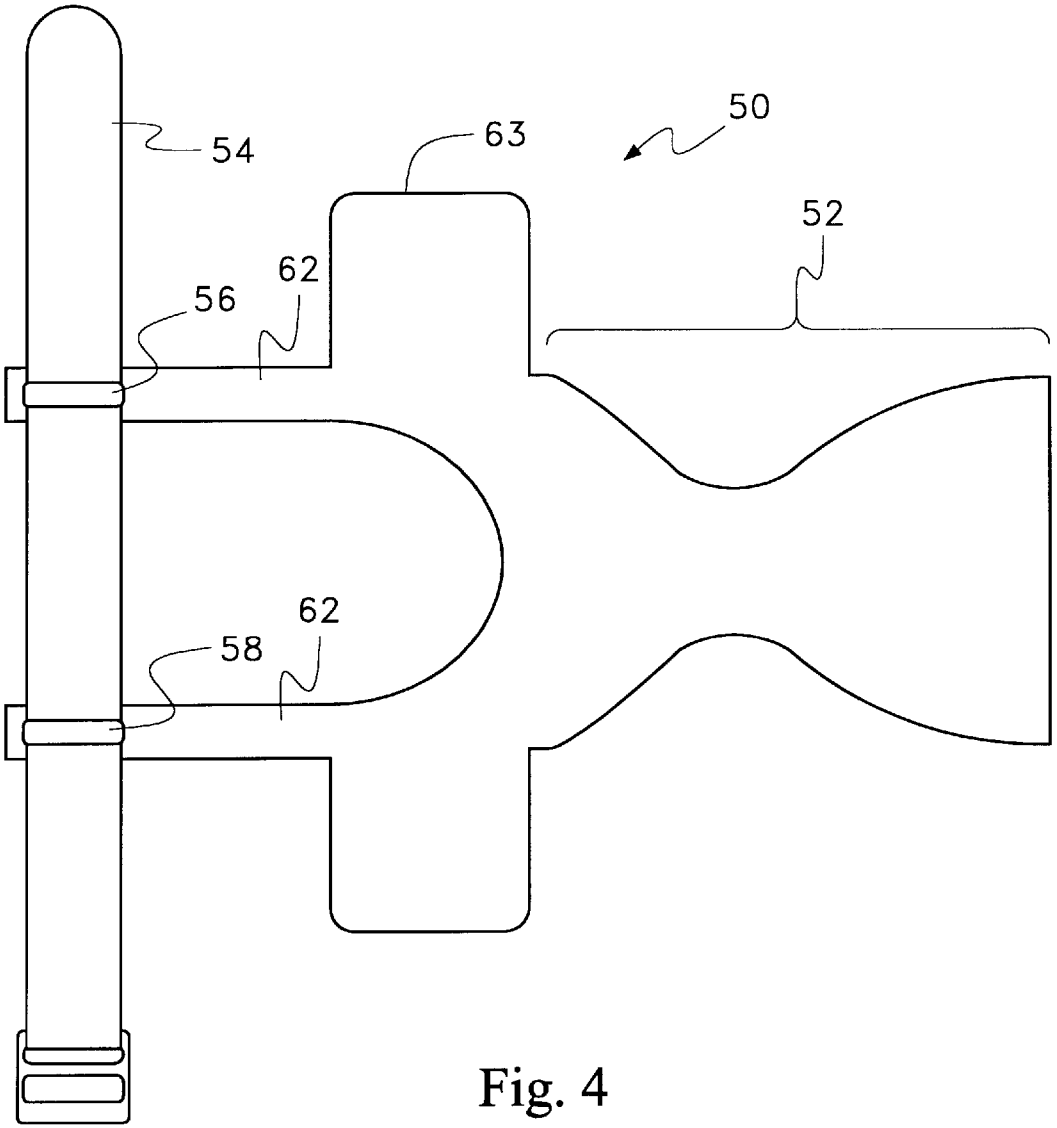
FIG. 4 is a top view of an alternate embodiment of a platform device.

Referring to FIG. 4, there is shown an alternate embodiment of a platform device 50 in accordance with the present invention. In this embodiment, the base section 52 of the platform device 50 is shaped like one half of an hourglass in order to add to the overall aesthetics of the device. In the shown embodiment a single strap 54 is shown. This strap 54 passes through loops 56, 58 on both of the elongated arms 60, 62.

To apply the platform device 50, the strap 54 is only passed through one of the loops 56, 58 on one of the elongated arms 60, 62. The elongated arms 60, 62 are then passed along the sides of the rail structure of a skate as has been previously described. Once seated in place, the strap 54 is passed through the second of the loops on the opposite elongated arm. The strap 54 is then tightened at around the top of the boot. The presence of the strap 54 in between the elongated arms 60, 62 further prevents the platform device from moving relative the skate once attached to the skate.

In the platform device 50 of FIG. 4, optional side projections 63 are shown. The side projections 63 extend out from the sides of the skate when the platform device 50 is added to a skate. As such, a platform would exist on the side of the skate upon which a skater can rest the opposing foot.

The purpose of showing the alternate embodiment of FIG. 4 is to illustrate that the present invention platform device can be made in a variety of different designs. The platform provided by the platform device can extend from the rear of the skate, the sides of the skate or even the front of the skate. Furthermore, the means for attaching the platform device to a skate can also be accomplished in numerous ways.

Figure 5:
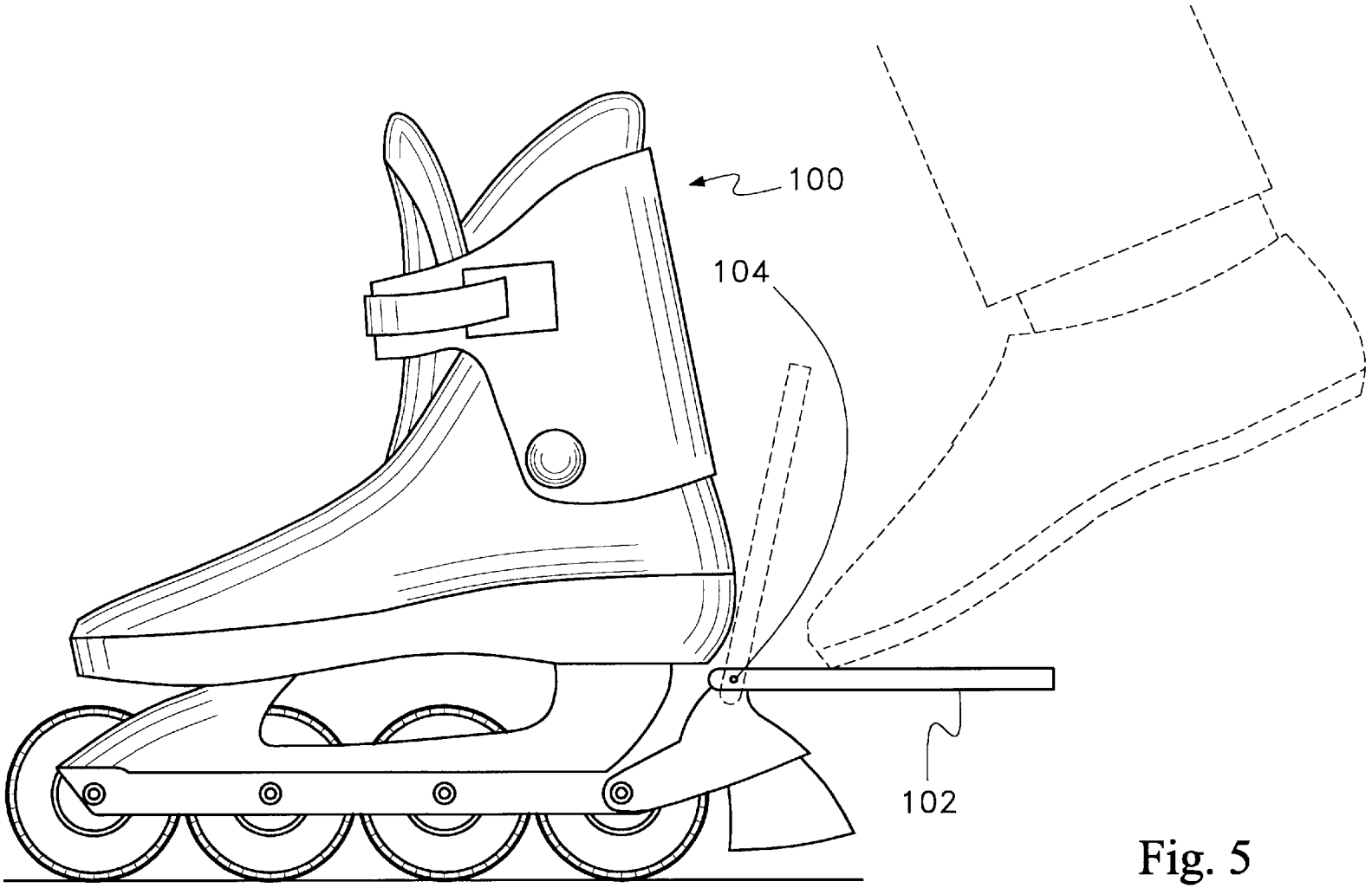
FIG. 5 is a side view of a skate with an integral platform in accordance with the present invention.

The embodiments of FIG. 1–FIG. 4 show the described platform device as a separate structure that can be added to an in-line skate in a retroactive manner. However, it should be understood that the present invention is intended to cover skates where a supporting platform is integrated as part of the skate. Referring to FIG. 5, there is shown an in-line skate 100. The in-line skate 100 has a platform structure 102 that it affixed to the heel of the skate 100 with a hinge 104. The hinge 104 enables the platform 102 to be selectively moved from a vertical stowed position to a horizontal deployed position. The platform 102 can be flat, as is shown, or can be slightly curved to conform to the rear of the skate boot when in the vertical stowed position.

It will therefore be understood that the embodiments of the present invention described and illustrated herein are merely exemplary and a person skilled in the art can make many variations to the embodiments shown without departing from the scope of the present invention. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A skate assembly, comprising:

i. a skate having:

a boot;

a rigid sole disposed at the bottom of said boot, wherein said sole has a first predetermined width;

a rail structure extending downwardly from said sole, wherein said rail structure has a second predetermined width; and ii. a platform extension extending from said skate, said platform extension having two generally parallel arms extending therefrom, wherein a gap exists between said arms that is wider than said second predetermined width but not as wide as said first predetermined width, thereby enabling said arms to be positioned on either side of said rail structure under said sole, said arms supporting said platform extension beyond said sole a distance sufficient to provide a surface external of said boot upon which a skater's foot may rest, and a strap that passes over said boot from one of said arms to the other.

2. The assembly according to claim 1, wherein said platform extension is an independent structure that can be selectively removed and added to said skate.

3. The assembly according to claim 1, wherein said strap engages said boot and biases said arms against said sole on either side of said rail structure.

4. A platform device for use on a skate of the type having a boot, a sole of a first predetermined width at the bottom of the boot, and a rail structure of a second predetermined width extending downwardly along the center of said sole, said platform device comprising:

a rigid element having a base section and two generally parallel arms extending from said rigid element, wherein a gap exists between said arms that is wider than said second predetermined width but not as wide as said first predetermined width;

a strap to coupled to said arms, wherein said strap is capable of passing over said boot from one of said parallel arms to the other, to engage the skate and bias said arms against the sole of the skate on either side of said rail structure.

5. A method of attaching a platform to a skate of the type having a boot, a sole of a first predetermined width at the bottom of the boot, and a rail structure of a second predetermined width extending downwardly along the center of said sole, said method comprising the steps of:

providing a platform; and affixing said platform to a skate with at least one strap so that at least one section of said platform extends outwardly from the skate.

6. The method according to claim 5, wherein said platform defines a slot having a width that is wider than said second predetermined width and is narrower than said first predetermined width, and said step of affixing said platform to a skate includes advancing said rail structure into said slot until at least one section of said platform abuts against and is supported by said rail structure.

7. The method according to claim 6 further including the step of biasing said platform at least one point proximate said slot against said sole of said skate.

* * * * *